US006862415B2

(12) United States Patent
Anthony et al.

(10) Patent No.: US 6,862,415 B2
(45) Date of Patent: Mar. 1, 2005

(54) DEVICE FOR TREATING THE SURFACE OF AN ARTICLE IN CONNECTION WITH PRINTING

(75) Inventors: James D. Anthony, Victor, NY (US); Terry N. Morganti, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/184,350

(22) Filed: Jun. 27, 2002

(65) Prior Publication Data

US 2003/0021611 A1 Jan. 30, 2003

Related U.S. Application Data

(60) Provisional application No. 60/301,261, filed on Jun. 27, 2001.

(51) Int. Cl.[7] ..... G03G 15/20
(52) U.S. Cl. ..... 399/67
(58) Field of Search ..... 399/67, 222, 320, 399/328

(56) References Cited

U.S. PATENT DOCUMENTS

| | | | | |
|---|---|---|---|---|
| 4,017,851 A | | 4/1977 | Felice | |
| 4,449,081 A | | 5/1984 | Doemen | |
| 4,638,281 A | | 1/1987 | Baermann | |
| 4,680,515 A | | 7/1987 | Crook | |
| 4,912,379 A | | 3/1990 | Matsuda et al. | |
| 5,178,070 A | | 1/1993 | Zorn et al. | |
| 5,228,792 A | | 7/1993 | Crevecoeur et al. | |
| 5,247,336 A | | 9/1993 | Mills, III | |
| 5,418,451 A | | 5/1995 | Maass et al. | |
| 5,701,552 A | | 12/1997 | Stephany et al. | |
| 5,930,554 A | * | 7/1999 | Godlove | 399/55 |
| 6,052,546 A | | 4/2000 | Aslam | |

FOREIGN PATENT DOCUMENTS

| | | | |
|---|---|---|---|
| EP | 0 311 020 A2 | | 4/1989 |
| EP | 0 462 729 A2 | | 12/1991 |
| GB | 2 115 931 A | | 9/1983 |
| JP | 63-013086 | * | 1/1988 |
| JP | 10-319776 | * | 12/1998 |

OTHER PUBLICATIONS

Product data sheet for Honeywell Micro Switch, SR13C–A1.

* cited by examiner

*Primary Examiner*—Quana Grainger
(74) *Attorney, Agent, or Firm*—Kevin L. Leffel

(57) ABSTRACT

The invention relates to a device and method for treating the surface of an article in connection with printing. More particularly, the invention relates to a method and device, which is capable of checking the motion of a roller in a device for fixing toner on printed sheet or web material using a magnet and a magnetic sensitive element located in a fixed position near the rotating element so as to sense the passage of at least a pole thereof at each rotation of the magnet.

9 Claims, 4 Drawing Sheets

DEVICE FOR TREATING THE SURFACE OF AN ARTICLE IN CONNECTION WITH PRINTING

This application claims priority to provisional application Ser. No. 60/301,261 filed Jun. 27, 2001, with the same title.

FIELD OF THE INVENTION

The present invention relates to a device for treating the surface of an article in connection with printing.

More particularly, the invention relates to a device, which is capable of checking the motion of a roller in a device for fixing toner on printed sheet or web material.

BACKGROUND OF THE INVENTION

In electrophotography or in ionography a charge image is generated by selectively discharging a homogenous pre-charged insulating surface of a recording member, onto which toner is deposited. The developed toner image is then transferred to a sheet or web of paper with an electrostatic field. After the developing process, the toner image could be easily disturbed by mechanical effects. Therefore, the toner image is fixed to the paper by heat and pressure. Typically the paper is transported in a nip between a fuser and a pressure roller, which are rotating. Inside the fuser roller or inside heater rollers contacting the fuser roller a heating lamp is installed. The thermal radiation of the lamp heats the surface of the fuser roller or the surface of the heater rollers. The thermoplastic toner on the paper becomes liquid and is pressed into the paper fibers. The fibers act as a capillary system into which molten toner can flow. If the fuser roller stops rotating in an error situation, it would lead to overheating. An overheat condition could lead to freezing the roller bearings or cause the roller break. Therefore motion sensors are required to ensure that a fuser roller does not stop rotating in a standby mode or that the fuser is shut down if the fuser roller stops rotating.

It is well known to use a magnetic sensor to detect a metal tab attached to an end of a heater roller. The magnetic sensor incorporates it's own internal magnetic field. As the heater roller rotates, the passing metal tab distorts the magnetic field. The magnetic sensor changes it's logic state every time the metal tap passes to indicate the heater roller is rotating. The position of the magnetic sensor to the metal tab is critical. This means much effort to adjust the sensor so that a proper signal is obtained. To adjust the sensor mounting brackets and adjusting screws are required which adds cost to the assembly not only for the material but also the labor.

It is an object of the present invention to develop a device for treating the surface of an article in connection with printing including a motion sensor for at least one rotating element, whereby the sensor, it's mounting elements and the adjusting are less cost intensive.

It is another object of the present invention to increase the reliability of the motion detection to prevent failures of a printing device including a printing material treating device.

SUMMARY OF THE INVENTION

Briefly, the present invention is concerned with a device for treating a surface of an article in connection with printing involving a treating source, a conveyer for leading the article along the source, a rotating element, a signaling member mechanically linked with the rotating element and a sensor for detecting the motion of the rotating element. The signaling member contains a magnet having opposite poles and the sensor is a magnetic-sensitive element being located in a fixed position near the rotating element so as to sense the passage of one of the poles thereof at each passage of said magnet. In particular, if the device is within a fusing unit of an electrophotographic machine the magnet could directly or by fixing means installed on a side of a heater roller which contacts a fuser roller. The article in form of a sheet or a web is then transported through a nip between the fuser roller and a pressure roller. More particular the sensor is a Hall-Effect position sensor.

Arranging such device allows easy installation with non expensive parts. The distance between the sensor and the magnet is not as critical. The treating source energy, especially the heat source, has no negative impact on the detecting characteristics. This makes it possible to design treating devices with much higher energy application. This configuration is insensitive against mechanical oscillations of the printing machine.

For better understanding of the present invention, reference may be had to the accompanying drawings.

DETAILED DESCRIPTION OF THE DRAWINGS

DETAILED DESCRIPTION

Figure 1:
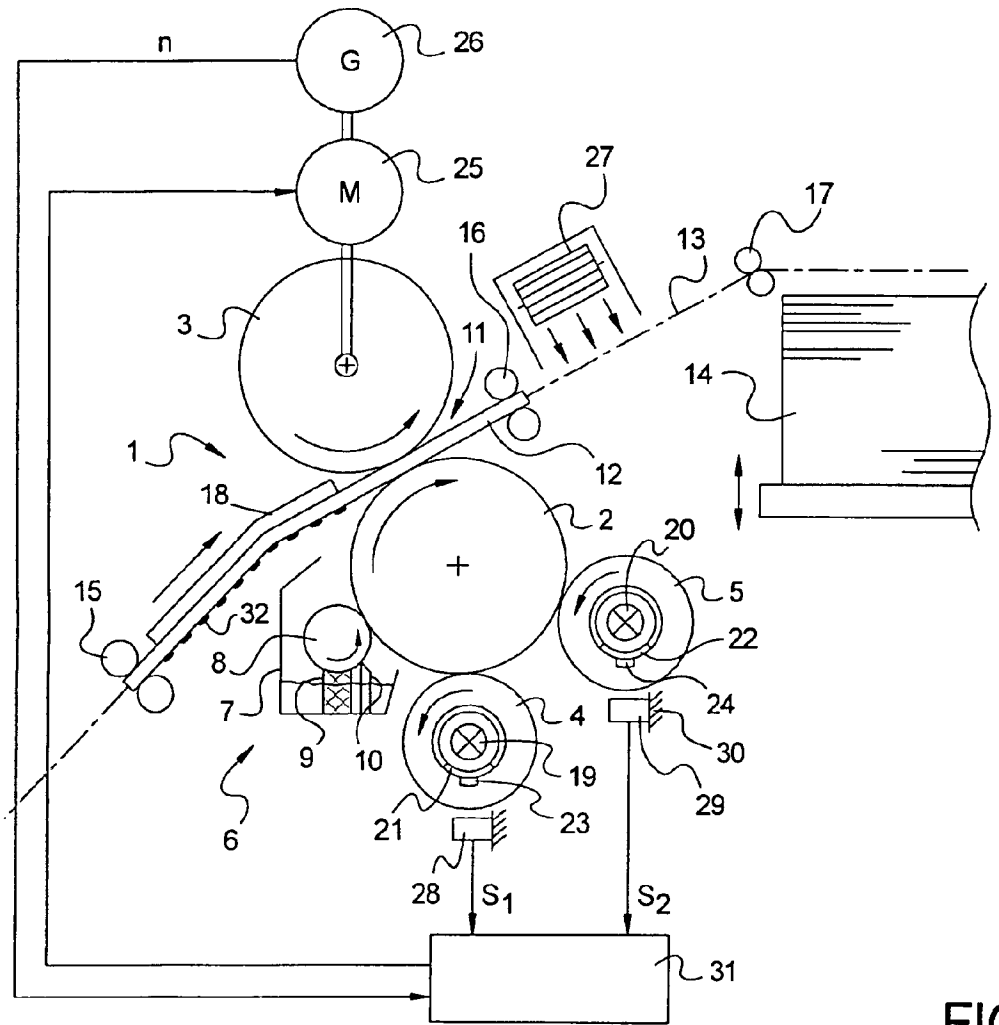
FIG. 1 is an schematic view of a fixing station of an electrophotographic apparatus.

The present embodiments described herein, provide the ability to more reliably detect the rotation of a rotating element within a device for treating the surface of an article. The treating source which also acts on the rotating element and on a sensor for detecting the rotation has no negative influence on the detecting process. The device is shown as implemented in a reproduction device utilizing a fixing station for a toner image. However, it should be understood that the present embodiments can be implemented in copying or printing devices that utilizes other types of treating devices, like cooling, radiation, drying or coating devices. The article to be treated could be a sheet or a web. The expression rotating element includes drums, rollers, cylinders, endless elements like a belt, and similar structures. The term magnet includes permanent magnets as well as magnet poles made by a current flow through a coil. The term magnetic-sensitive element not only incorporates hall effect digital position sensors. All other magnetic-sensitive elements are applicable which have the similar receiving characteristics of a hall effect sensor.

For a general understanding of the features of the present invention, reference is made to the drawings. In the drawings, like reference numerals have been used throughout to identify like elements.

Referring to FIG. 1 there is shown a fusing unit 1 of an electrophotographic reproduction machine like a copier or a printer. Fusing unit 1 employs a fusing roller 2, a pressure roller 3, two heating rollers 4, 5 and an oiler 6 with a oil container 7, a oil application roller 8, a oil transporting wick 9 and an oil metering doctor blade 10. The pressure roller 3 and the fusing roller 2 establishing a nip 11 in which a sheet 12 could be transported. For transporting the sheets 12 along a paper path 13 from a printing unit to a stack 14 transport roller pairs 15, 16, 17 and guiding elements 18 are arranged. Inside the heating rollers 4, 5 heating lamps 19, 20 are installed. On the sides of the heating rollers 4, 5 spring like tabs 21, 22 are mounted. Magnets 23, 24 are molded at the end of the tabs 21, 22. The pressure roller 3 is coupled with a motor 25. To measure the motor 25 speed a rotary encoder 26 is also coupled with the pressure roller 3. Downstream of the fusing unit 1 a cooling unit 27 is arranged. Near the magnets 23, 24 hall effect digital position sensors 28, 29 are mounted on the frame 30. The rotary encoder 26, the sensors 28, 29 and the motor 25 are connected to a control device 31.

When the pressure roller 3 is actively driven by the motor 25 all other rollers 2, 4, 5, 8 in the fusing unit 1 may be passively driven by friction according to the shown directions. The rotary speed of the pressure roller 3 is controlled with the help of the control device 31. The rotary encoder 26 gives the actual value of the rotary speed. The lamps 19, 20 heating the body of the rollers 4, 5. While the rollers 4, 5 contact the fuser roller 2 the heat is transferred to the surface of the fuser roller 2. If a sheet 12 is supplied to the nip 11, the toner image on the sheet 12 will be fixed by the heat of the fuser roller 2 and the pressure established between the pressure roller 3 and the fuser roller 2. The oil applied by the oiler 6 to the surface of the fuser roller 2 is to prevent toner particles 32 sticking to the fuser roller 2 after the sheet leaves the nip 11. After the nip 11 the sheet 12 is still warm. The temperature of the sheet 12 is cooled down to room temperature with the cooling unit 27 preventing sheets 12 from sticking together on the stack 14 because of still melted toner particles 32.

Figure 2:
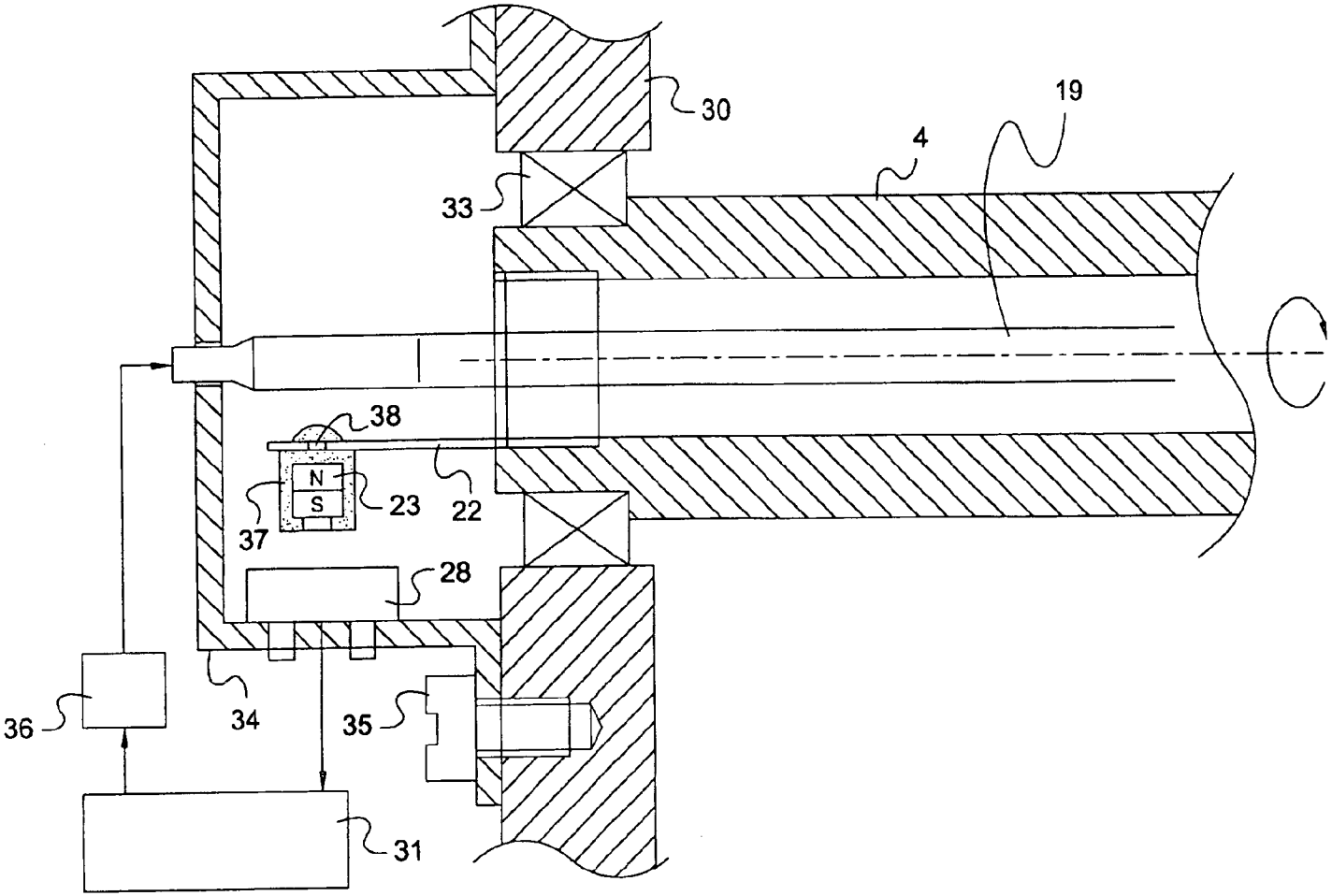
FIG. 2 is a side view of a heater roller motion detection of FIG. 1.

FIG. 2 is a side view of the heater roller 4 and it's detection of motion. The heater roller 4 is held in bearings 33 in the frame 30. The sensor 28 is fixed at a bracket 34 which is secured at the frame 30 with a screw 35. The bracket 34 also holds one end of the lamp 19. The lamp 19 is connected to a power supply 36, which could be switched off and on by the control device 31. The magnet 23 on the tab 22 is embedded in a thermal plastic material 37, which also serves as a fixing material through a hole 38 in the tab 22. To reduce the need for close detection, the magnet 23 is a Rare Earth Magnet of large Gauss strength. A strong magnet allows for larger dimensional tolerances. In a certain embodiment, the magnet has a strength in the range from 11,700 to 12,500 Gauss, and the sensors 28 and 29 are catalogue number SR13C-A1 hall effect digital postion sensors featuring a snap-in housing, sinking output, unipolar magnetics, and 3.8 to 30 Vdc supply voltage, available from Honeywell Micro Switch, U.S.A. As mentioned previously, the invention is not limited to these specifics as other magnets and magnetic sensitive elements may be implemented in the practice of the invention.

As shown in FIGS. 1 and 2 the magnets 23, 24 with their poles N, S oppose the sensors 28, 29. In this position of the magnets 23, 24 the magnetic field is strong enough to trigger the sensors 28, 29 to high potential on their output. When the magnets 23, 24 leave the sensing area of the sensors 28, 29 the potential falls back to low.

Figure 3:
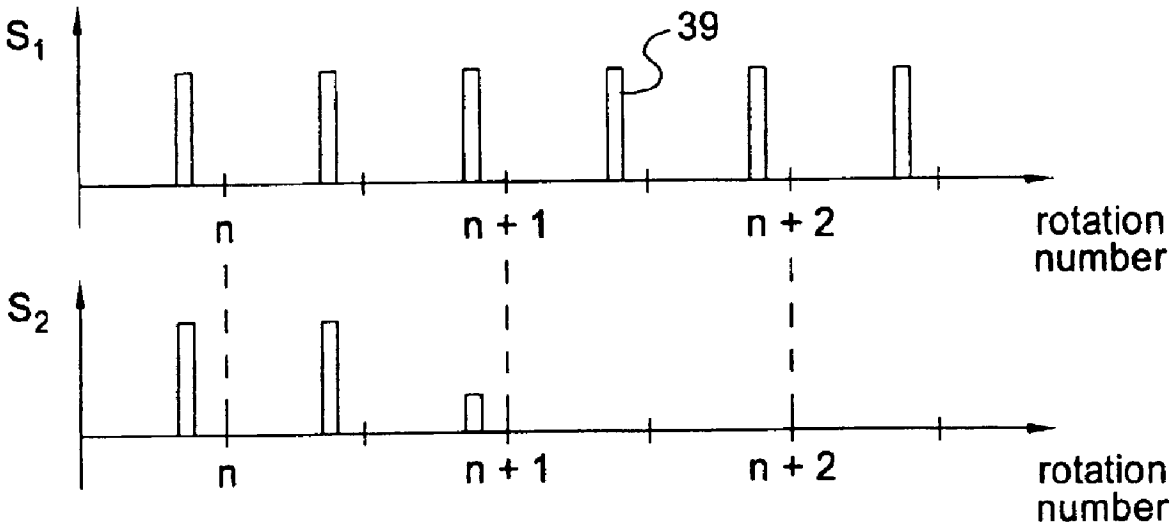
FIG. 3 is a diagram illustrating the signal evaluation of the magnetic-sensitive elements.

The output signals s1 and s2 of the sensors 28, 29 are shown in FIG. 3. The abscissas show the number of rotations of the driving pressure roller 3. The ordinates show the voltage level at the output of the sensors 28, 29. In this example within one rotation of the pressure roller 3 the magnets 23 24 oppose the sensors 28, 29 twice. Signal s2 is showing fault wherein after n revolutions the signal s2 of sensor 29 drops out and does not return to normal. Assuming the sensor 29 and its connection to the control 31 is not defective, this is an indication that the roller 5 has stopped rotating. The control 31 may determine wether the roller 5 is rotating by evaluating the time between the signal pulses 39, or by measuring the frequency of the pulses 39, or by counting the pulses 39, or other suitable method.

According to an aspect of the invention, the control 31 may contain a logic that processes a signal that indicates the heating roller 5 is rotating. If a transition of the signals s1, s2 is not received for example during a 10 second period, the printer will cycle down and present an operator with a message that heater roller 5 motion has stopped and request a service call. In this state the control device 31 may terminate power from the power supply 36 to prevent an overheat condition of the heating roller 4.

Figure 4:
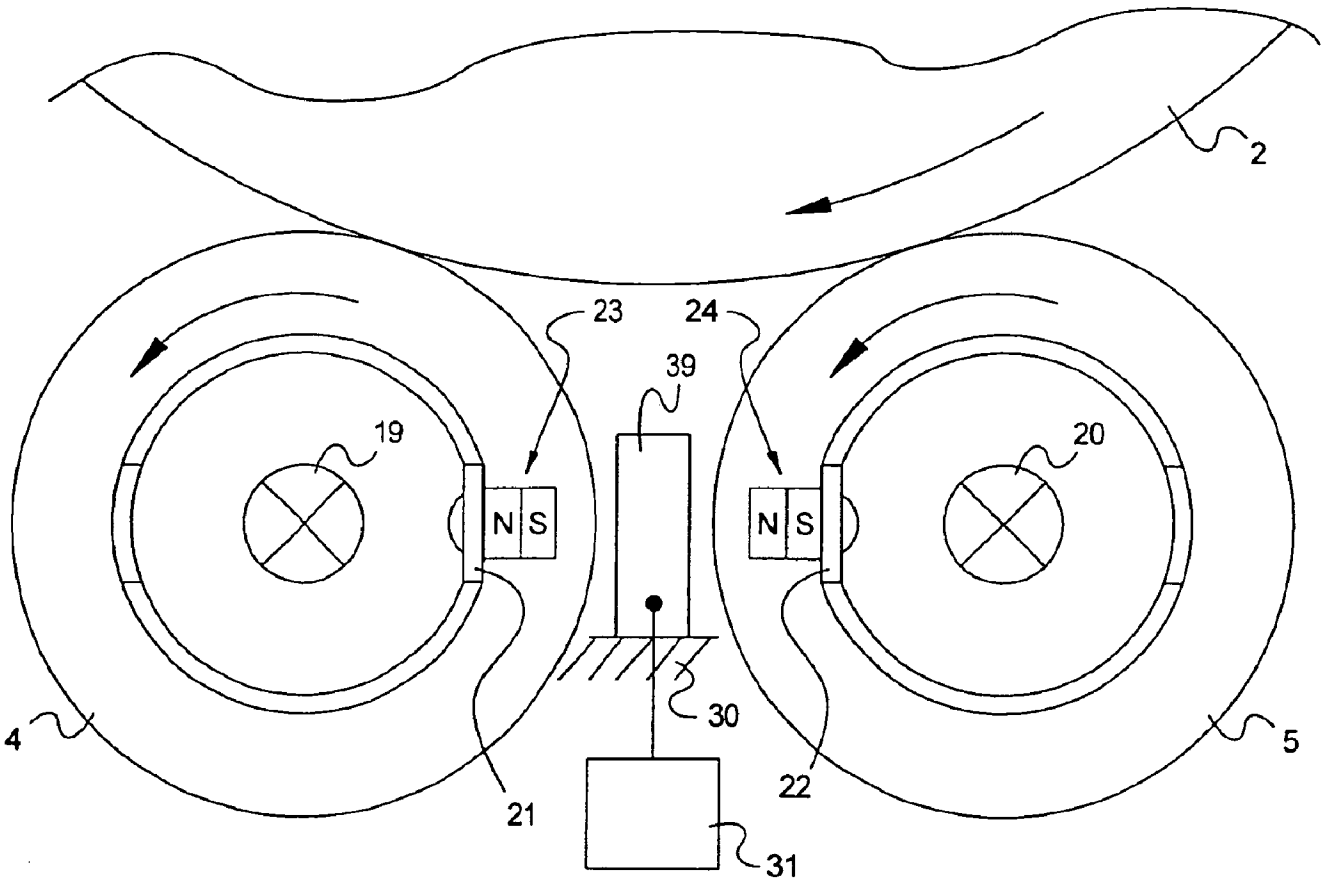
FIG. 4 shows a variant with one magnetic-sensitive element to detect rotation of two rollers.

FIG. 4 shows a variant with one magnetic-sensitive element to detect rotation of the two heating rollers 4, 5. A Hall-Effect ratiometric linear transducer sensor 39 is mounted between the rollers 4, 5 to register the magnet field from the magnets 23, 24. The poles N, S of the magnets mounted on the tabs 21, 22 are inverse in relation to the sensor 39 to distinguish which magnet 23, 24 causes a voltage change, respectively which of the rollers is still rotating. This configuration minimizes the number of sensors 39.

What is claimed is:

1. Device for treating the surface of an article in connection with printing, comprising:

a treating source directed to the surface;

a conveyer for leading the article along the source;

at least one rotating element;

a signaling member mechanically linked with the rotating element;

a sensor for detecting the rotation of the rotating element and directed to the movement path of the signaling member;

wherein said signaling member is a magnet having opposite poles and said sensor is a magnetic-sensitive element being located in a fixed position near the rotating element so as to sense the passage of at least a pole thereof at each rotation of said magnet;

wherein the conveyer comprises a fuser roller and a pressure roller establishing a nip in which the article is transported and with at least one heater roller in contact with the fuser roller, the at least one heater roller having an inside heat source.

2. Device according to claim 1, wherein the magnet is installed directly on a side of the at least one heater roller.

3. Device according to claim 1, wherein the magnet is installed on a member mechanically linked to the at least one heater roller.

4. Device for treating the surface of an article in connection with printing, comprising:

a treating source directed to the surface;

a conveyer for leading the article along the source;

at least one rotating element;

a signaling member installed on the rotating element;

a sensor for detecting the rotation of the rotating element and directed to the movement path of the signaling member;

wherein said signaling member is a magnet having opposite poles and said sensor is a magnetic-sensitive element being located in a fixed position near the rotating element so as to sense the passage of at least a pole thereof at each rotation of said magnet;

wherein the magnetic-sensitive element is a hall effect digital position sensor.

5. Method for detecting a rotating element in a device for treating the surface of an article in connection with printing, comprising the steps of:

rotating a magnet having opposite poles synchronously with the element;

detecting the passage of at least one pole of the magnet with a fixed magnetic-sensitive element;

analyzing the output signal of the magnetic-sensitive element to determine if the rotating element is stopping.

6. Method according to claim 5, wherein the treating source is a heat source.

7. Device for fixing a toner image on a recording article by using heat, comprising:

a conveyer for the article comprising a fuser roller and a pressure roller establishing a nip in which the article is transported with the toner image contacting the surface of the fuser roller;

at least one heater roller in contact with the fuser roller, the at least one heater roller having an inside heat source;

a magnet having opposite poles installed directly on a side of the at least one heater roller;

a fixed magnetic-sensitive element being located in a fixed position near the rotating track of the magnet so as to sense the passage of one of the poles thereof at each rotation of said magnet.

8. Device according to claim 7, wherein one magneto-sensitive element is located near the rotating track of two magnets which are installed on different heater rollers.

9. Device according to claim 8, wherein the poles of the magnets on the heater rollers are inverse in relation to the magnetic-sensitive element.

* * * * *